United States Patent [19]

Asakura et al.

[11] Patent Number: 4,977,349

[45] Date of Patent: Dec. 11, 1990

[54] LOW-PRESSURE MERCURY VAPOR DISCHARGE LAMP

[75] Inventors: Masahiko Asakura, Yokosuka; Kimio Shiraiwa, Yokohama; Yoichi Hattori; Naotosi Toume, both of Yokosuka, all of Japan

[73] Assignee: Kabushiki Kaisha Toshiba, Kanagawa, Japan

[21] Appl. No.: 412,622

[22] Filed: Sep. 26, 1989

Related U.S. Application Data

[63] Continuation of Ser. No. 55,055, May 28, 1987, abandoned.

[30] Foreign Application Priority Data

May 29, 1986 [JP] Japan ..... 61-122172

[51] Int. Cl.[5] ..... H01J 61/20; H01J 61/24; H01J 61/30

[52] U.S. Cl. ..... 313/490; 313/493; 313/565

[58] Field of Search ..... 313/493, 564, 565, 552, 313/571, 639, 490

[56] References Cited

U.S. PATENT DOCUMENTS 4,288,715 9/1981 van Overveld ..... 313/565
4,353,007 10/1982 Moerkens et al.. ..... 313/493
4,481,442 10/1984 Albrecht et al. ..... 313/493
4,636,686 1/1987 Vrieze ..... 313/565

FOREIGN PATENT DOCUMENTS 55-53053 4/1980 Japan .
60-225346 11/1985 Japan .
57-48555 3/1986 Japan .
36-27470 10/1986 Japan .
2023924 1/1980 United Kingdom ..... 313/493

*Primary Examiner*—Kenneth Wieder
*Attorney, Agent, or Firm*—Finnegan, Henderson, Farabow, Garrett, and Dunner

[57] ABSTRACT

A low-pressure mercury vapor discharge lamp. The lamp includes at least two tube sections substantially parallel to each other for holding a quantity of mercury vapor, sealings for sealing one end of each of two of the tube sections, discharge electrodes for activating the mercury vapor for generating a luminescent discharge, a reduced diameter connecting tube for sealing the remaining ends of the tube sections to one another in successive pairs, and an amalgam for maintaining the mercury vapor pressure at a level which maintains the luminance of the discharge at a substantially constant value.

14 Claims, 2 Drawing Sheets

LOW-PRESSURE MERCURY VAPOR DISCHARGE LAMP

This application is a continuation of application Ser. No. 07/055,055, filed May 28, 1987, now abandoned.

BACKGROUND OF THE INVENTION

1. Field of the invention

The present invention relates to a low-pressure mercury vapor discharge lamp, and more particularly to a low-pressure mercury vapor discharge lamp made of a single piece glass tube bent into a generally U-shaped configuration.

2. Description of the Prior Art

The bent type low-pressure mercury vapor discharge lamp such as a fluorescent lamp, basically, has a tubular discharge envelope bent once or several times, which consists of several straight, parallel longitudinal tube sections and at least one transverse connecting tube section. The transverse connecting tube section connects a pair of the longitudinal tube sections so that the longitudinal tube sections are united into a continuous bent tube together with the transverse connecting tube section.

Opposite ends of the resultant continuous bent tube are aligned in the same direction and sealed. The sealed ends are provided with stems for supporting discharge electrodes, and covered by a base member which permits the low-pressure mercury vapor discharge lamp to be used in a suitable fixture. The discharge electrodes are electrically connected to terminal pins mounted on the base member. This structure provides a relatively compact low-pressure mercury vapor discharge lamp.

Low-pressure mercury vapor discharge lamps are known in which the transverse connecting tube section is curved to a substantially U-shape (e.g., U.S. Pat. No. 4,353,007), or in which the transverse connecting tube section is bent once or several times (e.g., U.S. Pat. No. 4,481,442).

Low-pressure mercury vapor discharge lamps are also known in which the transverse connecting tube section is curved and constricted at portions adjacent to the longitudinal tube sections, or in which a straight transverse connecting tube section connects or bridges a pair of longitudinal tube sections at portions near their respective one ends.

A problem associated with these known low-pressure mercury vapor discharge lamps is a relatively low temperature region of the mercury vapor in the tubular discharge envelope, within the transverse connecting tube section.

For example, one conventional U-shaped type low-pressure mercury vapor discharge lamp (e.g., U.S. Pat. No. 4,353,007) has a curved transverse connecting tube section with a uniform diameter the same as that of the longitudinal tube sections. When this type of low-pressure mercury vapor discharge lamp is turned on, a low temperature region of the mercury vapor tends to occur in a region furthest from the discharge electrodes of the lamp. This occurs because the discharge of the mercury vapor is less activated in this region.

The low temperature region of the mercury vapor arises in the curved transverse connecting tube section. This causes the luminance of the low-pressure mercury vapor discharge lamp to be reduced at the low temperature region. Further, the mercury vapor pressure in the low-pressure mercury vapor discharge lamp lowers in accordance with the temperature of the mercury vapor in the low temperature region. As a result, the mercury vapor condenses and results in a so-called black shade, i.e., a film of mercury compound on the glass wall near the low temperature region.

Another conventional bent-type low-pressure mercury vapor discharge lamp (e.g., U.S. Pat. No. 4,481,442) has a flat transverse connecting tube section. The resulting discharge envelope has expanded its corner portions between the flat transverse connecting tube section and the longitudinal tube sections.

In this type of low-pressure mercury vapor discharge lamp, the discharge of the mercury vapor is less activated in regions near the corners of the expanded corner portions. The temperature of the mercury vapor is lowered at these regions in comparison to the temperature in other regions due to the reduced activation of the discharge. As a result, the luminance of the low-pressure mercury vapor discharge lamp is reduced at the low temperature regions. Morever, the mercury vapor pressure in the low-pressure mercury vapor discharge lamp lowers in accordance with the temperature of the mercury vapor in the low temperature region. The mercury vapor then condenses and results in a black shade film of mercury compound on the corner glass walls near these regions.

Referring to FIG. 1, the third conventional curved and constricted type low-pressure mercury vapor discharge lamp 10 has a transverse connecting tube section 11. In the manufacturing process of this type of low-pressure mercury vapor discharge lamp 10, a straight discharge envelope with a diameter DO is heated at its mid portion. Then, the straight discharge envelope is bent at the mid portion by using a mandrel. In the manufacturing process as described above, the discharge envelope tends to be reduced at portions 13*a* and 13*b*. On the other hand, the discharge envelope tends to be expanded at a middle portion 12.

Thus, the mid portion of the discharge envelope becomes a curved and constricted transverse connecting tube section 11, as shown in FIG. 1. The resulting curved and constricted transverse connecting tube section 11 has an elongated tube portion 12 with a diameter D1 at its mid length portion and a pair of reduced tube portions 13*a* and 13*b*, each having the diameter D2, in its end portions adjacent to longitudinal tube sections 14*a* and 14*b*, respectively. The diameters have the following relation: $D2 < DO$ and $D1 > DO$.

In this type of low-pressure mercury vapor discharge lamp 10, the discharge of the mercury vapor is less activated in a region 18 near the elongated tube portion 12. This is because that the mercury vapor pressure lowers in the enlarged diameter portion 12 and the mercury vapor is less activated in a region 15 most far from discharge electrodes. The temperature of the mercury vapor lowers at the region 15 in comparison to the temperature in other regions due to the reduced activation of the discharge. This causes the luminance of the lamp 10 to be reduced at the low temperature region 15. Further, the mercury vapor in the low pressure mercury vapor discharge lamp 10 condenses and results in the so-called black shade, i.e., a film of mercury compound on the glass wall near the region 15, so that the luminance of the lamp 10 is further reduced at the low temperature region 18.

Referring to FIG. 2, the fourth bridged type low-pressure mercury vapor discharge lamp 20 has a straight transverse connecting tube section 21. The low-pressure mercury vapor discharge lamp 20 has a pair of longitudinal tube sections 24*a* and 24*b*, which are connected together at portions near adjacent ends via the straight transverse connecting tube section 21. Therefore, the longitudinal tube sections 24*a* and 24*b* have portions 26*a* and 26*b* which extend beyond the straight transverse connecting tube section 21.

In this type of low pressure mercury vapor discharge lamp 20, the discharge of the mercury vapor is less activated in regions 25*a* and 25*b* in the extended portions 26*a* and 26*b*. The temperature of the mercury vapor lowers at the regions 25*a* and 25*b* in comparison to the temperature in other regions due to the reduced activation of the discharge. This causes the luminance of the lamp 20 to be reduced at the low temperature regions 25*a* and 25*b*. Further, the mercury vapor in the low-pressure mercury vapor discharge lamp 20 condenses and results in the so-called black shade, i.e., a film of mercury compound on the glass wall near the regions 25*a* and 25*b*, so that the luminance of the lamp 20 is further reduced at the low temperature regions 25*a* and 25*b*.

SUMMARY OF THE INVENTION

An object of the present invention to provide a bent type low-pressure mercury vapor discharge lamp in which the luminance is not reduced by the conditions described above.

Another object of the present invention is to provide a bent type low-pressure mercury vapor discharge lamp in which a low temperature region does not arise.

In order to achieve the above objects, a low-pressure mercury vapor discharge lamp according to the present invention is provided with at least two longitudinal tube sections substantially parallel to each other for holding a quantity of mercury vapor, sealings for sealing one end of each of two of the longitudinal tube sections, discharge electrodes for activating the mercury vapor for generating a luminescent discharge, and a reduced diameter transverse connecting tube section for sealing the remaining ends of the longitudinal tube sections to one another in successive pairs, and an amalgam for maintaining the mercury vapor pressure at a level which maintains the luminance of the discharge at a substantially constant value.

BRIEF DESCRIPTION OF DRAWINGS

The present invention will now be described in detail with reference to the accompanying drawings, in which.

DETAILED DESCRIPTION OF THE PREFERRED EMBODIMENTS

Figure 1:
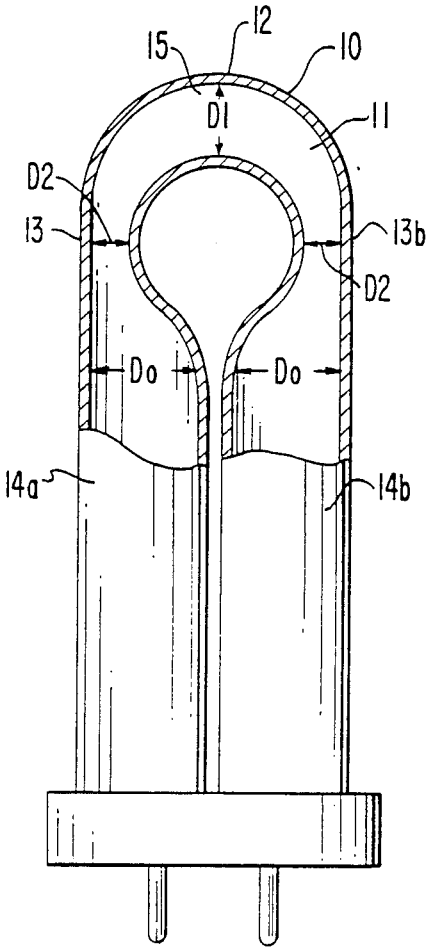
FIG. 1 (PRIOR ART)
FIG. 1 is a diagrammatic sectional view of a conventional low-pressure mercury vapor discharge lamp with a discharge envelope bent once.
Figure 2:
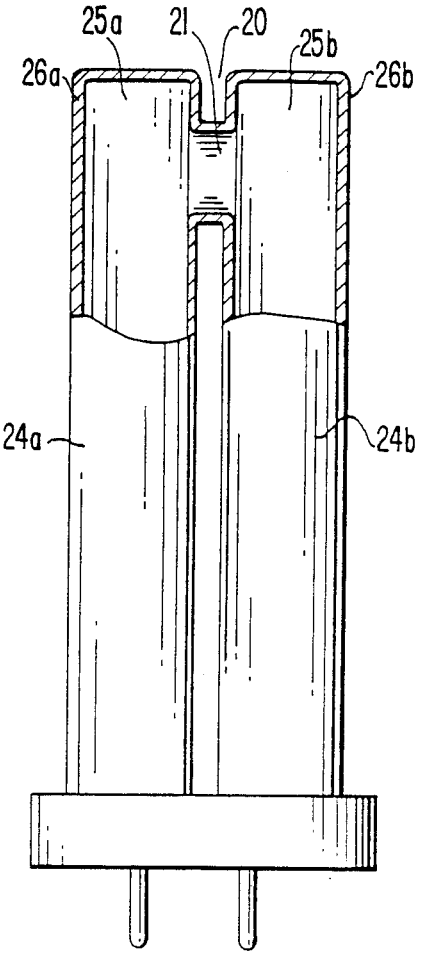
FIG. 2 (PRIOR ART)
FIG. 2 is a diagrammatic sectional view showing parts of other conventional low-pressure mercury vapor discharge lamps with a discharge envelope bent once.

The present invention will now be described in detail with reference to the accompanying drawings, i.e., FIGS. 3 and 4. Throughout the drawings, like reference numerals and letters are used to designate like or equivalent elements for the sake of simplicity of explanation.

Figure 3:
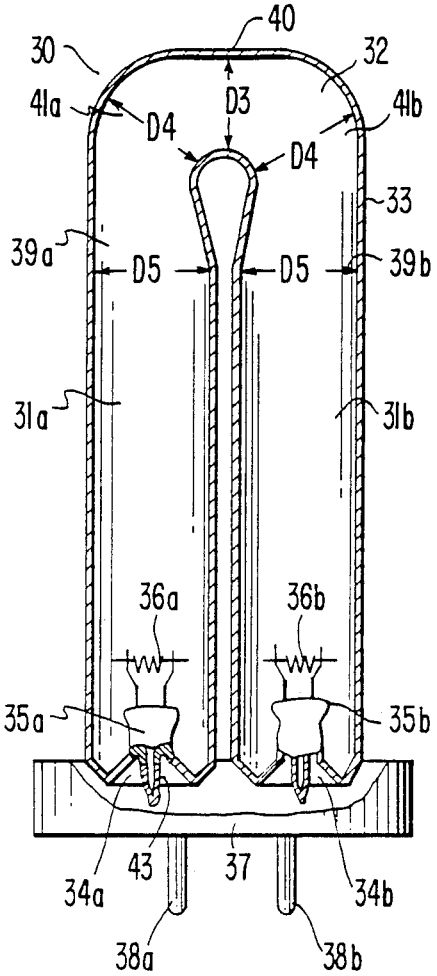
FIG. 3 is a diagrammatic sectional vieW of a low-pressure mercury vapor discharge lamp with a discharge envelope bent once, according to the present invention.

FIG. 3 shows an embodiment of a low-pressure mercury vapor discharge lamp 30 bent once, such as a U-shaped type fluorescent lamp, according to the present invention. The bent type low-pressure mercury vapor discharge lamp 30 has two longitudinal tube sections 31*a*, 31*b* and a transverse connecting tube section 32. The two longitudinal tube sections 31*a*, 31*b* are aligned in parallel with each other and are connected via the transverse tube section 32 at one end thereof. Thus, the longitudinal tube sections 31*a*, 31*b* are united into a continuous tube 33 bent once, by the transverse connecting tube section 32. Opposite ends 34*a*, 34*b* of the resulting continuous bent tube 33, i.e., respective other ends of the two longitudinal tube sections 31*a*, 31*b*, are sealed. As shown in FIG. 4, the sealed ends 34*a*, 34*b* are provided with stems 35*a*, 35*b* for supporting discharge electrodes 36*a*, 36*b* and covered by a base member 87 which permits the lamp 30 to be used in a suitable fixture. The discharge electrodes 36*a*, 36*b* are electrically connected to terminal pins 38*a*, 38*b* mounted on the base member 37 for activating luminescent discharge of the lamp 30.

The transverse connecting tube section 32 will now be described in detail. The transverse connecting tube section 32 is shaped generally in a U-shape, as shown in FIG. 3. The transverse connecting tube section 32 is so designed that a cross-section of the transverse connecting tube section 32 is at each section less than the cross-sections of the two longitudinal tube sections 31*a*, 31*b*. For example, the cross-section of the transverse connecting tube section 32 is gradually reduced from its end portions 39*a*, 39*b* adjacent to the longitudinal tube sections 31*a*, 31*b* to its mid portion 40. Therefore, the transverse connecting tube section 32 has a cross-section with a minimum diameter D3 at its mid portion 40, and a cross-section with a maximum diameter D5, equal to the diameter of the two longitudinal tube sections 31*a*, 31*b*, at its end portions 39*a*, 39*b*. Two corner portions 41*a*, 41*b* of the transverse connecting tube section 32 have a cross-section with a diameter D4, larger than the diameter D3, but smaller than than the diameter D6. That is, the diameters have the following relation: $D3<D4<D5$. Two corner portions 41*a*, 41*b* are taken at positions at which the cross-sections have an angle of 60° to the cross section at the mid portion 40. In actual examples, the longitudinal tube sections 31*a*, 31*b* are formed to have a cross-section with a diameter of 24 mm. The transverse connecting tube section 32 is formed to have cross-sections with diameters of approximately 20 mm and 22 mm at the mid portion 40 and the corner portions 41*a*, 41*b*, respectively. The glass wall of the tube 33 has a uniform thickness, e.g., 1 mm. Thus, the cross-sections of the portions 40, 39*a* (39*b*) and 41*a* (41*b*) have the inner wall surface diameters 18 mm, 22 mm and 20 mm.

The low-pressure mercury vapor discharge lamp 30 further stores a prescribed amount of amalgam 42. One of the stems 35*a*, 35*b* formed on the sealed ends 34*a*, 34*b* of the longitudinal tube sections 31*a*, 31*b*, e.g., the stem 35*a*, is provided with a thin pipe 43, as shown in FIG. 4.

The thin pipe 43 is extended from the stem 35*a* toward the base member 37 (see FIG. 3). The thin pipe 43 is opened at one end to the interior of the longitudinal tube section 31*a*, but sealed at its elongated end 44. The thin pipe 43 is further constricted at a predetermined portion 45. The amalgam 42 is stored in the space of the thin pipe 43 between the constricted portion 45 and the sealed end 44. In the actual examples, the amalgam 42 is indium-bismuth amalgam, i.e., an alloy of indium, bismuth and mercury, or indium-bismuth-silver amalgam, i.e., an alloy of indium, bismuth, silver and mercury. The mercury is included in the amalgams at 0.75 to 6 weight %.

Figure 4:
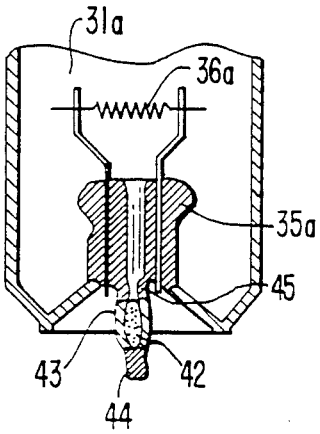
FIG. 4 is a diagrammatic sectional view showing the sealed end of the low-pressure mercury vapor discharge lamp of FIG. 3.

According to the embodiment of the invention shown in FIGS. 3 and 4, the mercury vapor pressure in the low-pressure mercury vapor discharge lamp 30 is not reduced because the transverse connecting tube section 32 has a progressively reduced cross-section cross-section of positions 39*a*, 39*b*, which are equal to the cross-sections of the two respective longitudinal tube sections 31*a*, 31*b* toward mid portion 40. Thus, the mercury vapor in the transverse connecting tube section 32 is more activated than the mercury vapor in the longitudinal tube sections 31*a*, 31*b*. Therefore, the temperature of the mercury vapor in the transverse connecting tube section 32 is maintained in a level sufficient level. Therefore, the mercury vapor does not condense on the glass wall of the tube 33 and not result in a black shade, i.e., a film of mercury compound.

The mercury vapor pressure tends to be increased in the transverse connecting tube section 32 more than in the longitudinal tube sections 31*a*, 31*b*. The amalgam 42 in the thin pipe 43 controls the pressure, i.e., a density of the mercury vapor in the tube 33 and prevents an excessive variation or unbalance of the density of the mercury vapor in the low-pressure mercury vapor discharge lamp 30. That is, the amalgam 42 in the thin pipe 43 applies or absorbs the mercury vapor according to the temperature in the low-pressure mercury vapor discharge lamp 30, so that the density of the mercury vapor is maintained at a prescribed value.

A Table below shows results of experiments made on samples of the present invention and conventional low-pressure mercury vapor discharge lamps with the rating of 17 W/100 V. The experiments were made on one hundred samples of the present invention and conventional lamps, respectively. In the experiments, the lumen maintenance ratio and the condition of the black shade after 1,000 hours of operation were observed.

TABLE

| | Initial Luminous Flux (%) | Lumen Maintenance Ratio (%) | Black Shade (number of samples) | | |
|---|---|---|---|---|---|
| | | | O | Δ | X |
| Present Invention | 100 | 96 | 99 | 1 | 0 |
| Conventional Lamp | 98.6 | 93 | 96 | 3 | 1 |

In the Table, the initial luminous flux of the present invention was given as 100. The Mark in the Black Shade column shows that no black shade was observed. The Mark Δ shows that a slight black shade was observed. The Mark X shows that a conspicuous black shade was observed.

As seen from the Table, the samples of the present invention have the initial luminous flux larger than the samples of the conventional lamp. Further, the luminous flux of the samples of the present invention was higher after 1,000 hours of operation than the samples of the conventional lamp. Also, the samples of the present invention are superior to the the samples of the conventional lamp in the suppression of the black shade.

The inventors have also examined samples of low-pressure mercury vapor discharge lamps with different wattage ratings or different sizes. The samples according to the present invention had a more prominent effect than the samples of the conventional lamps.

Various modifications and variations may be made in the invention, without departing from the scope or spirit of the invention. For example, the present invention is able to apply to low-pressure mercury vapor discharge lamps consisting of four or more even numbers of longitudinal tube sections, and a necessary number of transverse connecting tube sections for connecting the longitudinal tube sections.

What is claimed is:

1. A low-pressure mercury vapor discharge lamp, comprising:

at least two substantially parallel tube sections for holding a quantity of mercury vapor, said tube sections being exposed to the atmosphere;

sealing means for sealing one end of each of two of the tube sections;

stems disposed at each of said sealed ends of said tubes, at least one of said stems including a receptacle disposed at least partially exterior said tube sections;

connecting tube means for sealingly connecting the other ends of the tube sections to one another in successive pairs, portions of said connecting tube means having diameters that are less than the diameters of corresponding ones of the tube sections; and an amalgam positioned in the portion of said receptacle that is exterior said tube sections for maintaining the mercury vapor pressure at a level which maintains the luminance of the discharge at a substantially constant value.

2. The low-pressure mercury vapor discharge lamp of claim 1 wherein the connecting tube means includes at least one generally U-shaped tube joining two tube sections, and having a midpoint, the diameter of the U-shaped tube gradually increasing from the midpoint to each end thereof.

3. The low-pressure mercury vapor discharge lamp of claim 2 wherein the diameter of the U-shaped tube at each end thereof is equal to the diameter of the tube section connected thereto.

4. The low-pressure mercury vapor discharge lamp of claim 3 wherein the diameter of the U-shaped tube at the midpoint is about 20 mm, and the diameter at the ends of the U-shaped tube is approximately 24 mm.

5. The low-pressure mercury vapor discharge lamp of claim 4 wherein each tube sections includes a glass wall having a thickness of about 1 mm.

6. The low-pressure mercury vapor discharge lamp of claim 1 wherein the amalgam is indium-bismuth amalgam.

7. The low-pressure mercury vapor discharge lamp of claim 6 wherein the indium-bismuth amalgam includes 0.75 to 6 weight percent mercury.

8. The low-pressure mercury vapor discharge lamp of claim 1, wherein said receptacle includes an elongated pipe extending outward from said stem exterior said tube sections, said pipe being sealed at one end thereof and having a constricted portion, said amalgam being positioned between the sealed end of said pipe and the constricted portion of said pipe.

9. The low-pressure mercury vapor discharge lamp of claim 8, wherein the other end of said pipe is opened to the interior of said tube sections.

10. The low-pressure mercury vapor discharge lamp of claim 9, further comprising an electrode supported on each of each stems within said tube sections for activating the mercury vapor for generating a luminescent discharge.

11. A low-pressure mercury vapor discharge lamp, comprising:

at least two substantially parallel tube sections for holding a quantity of mercury vapor, said tube sections being exposed to the atmosphere;

sealing means for sealing one end of each of two of the tube sections;

means for activating the mercury vapor for generating a luminescent discharge;

connecting tube means for sealingly connecting the other ends of the tube sections to one another in successive pairs, portions of said connecting tube means having diameters that are less than the diameters of corresponding ones of the tube sections; and an indium-bismuth-silver amalgam positioned in one of the tube sections of each pair of tube sections for maintaining the mercury vapor pressure at a level which maintains the luminance of the discharge at a substantially constant value.

12. The low-pressure mercury vapor discharge lamp of claim 11, wherein the indium-bismuth-silver amalgam includes 0.75 to 6 weight percent mercury.

13. A low-pressure mercury vapor discharge lamp, comprising:

at least two substantially parallel tube sections for holding a quantity of mercury vapor;

sealing means for sealing one end of each of two of the tube sections;

means for activating the mercury vapor for generating a luminescent discharge;

connecting tube means for sealingly connecting the other ends of the tube sections to one another in successive pairs, portions of said connecting tube means having diameters that are less than the diameters of corresponding ones of the tube sections; and an indium-bismuth-silver amalgam positioned in one of the tube sections of each pair of tube sections for maintaining the mercury vapor pressure at a level which maintains the luminance of the discharge at a substantially constant value.

14. The low-pressure mercury vapor discharge lamp of claim 13, wherein the indium bismuth-silver amalgam includes 0.75 to 6 weight percent mercury.

* * * * *